US005601264A

United States Patent [19]

Peart

[11] Patent Number: 5,601,264

[45] Date of Patent: Feb. 11, 1997

[54] WRIST REST

[76] Inventor: Stephen Peart, 21116 Locust Dr., Los Gatos, Calif. 95031

[21] Appl. No.: 222,701

[22] Filed: Apr. 4, 1994

[51] Int. Cl.[6] ..... B68G 5/00

[52] U.S. Cl. ..... 248/118.1; 248/918; 248/631; 5/646; 5/708

[58] Field of Search ..... 248/118, 118.1, 248/118.3, 118.5, 918, 910, 631, 561; 5/623, 646, 454, 449, 644, 643

[56] References Cited

U.S. PATENT DOCUMENTS

| | | | |
|---|---|---|---|
| 72,802 | 12/1867 | Collins | 5/449 X |
| D 182,647 | 4/1958 | Cox | 5/449 X |
| D 264,164 | 5/1982 | Salibello et al. | 5/623 X |
| D 285,270 | 8/1986 | Hannah et al. . | |
| 941,043 | 11/1909 | Powell | 5/644 X |
| 1,810,556 | 6/1931 | Fenton | 5/644 X |
| 2,765,480 | 10/1956 | Mueller | 5/644 X |
| 4,528,705 | 7/1985 | Greenawalt | 5/644 |
| 4,616,798 | 10/1986 | Smeenge et al. . | |
| 4,621,781 | 11/1986 | Springer . | |
| 4,688,862 | 8/1987 | Fowler et al. . | |
| 4,774,735 | 10/1988 | Sanderson et al. | 5/449 |
| 4,826,123 | 5/1989 | Hannah et al. . | |
| 4,913,390 | 4/1990 | Berke . | |
| 4,976,407 | 12/1990 | Schwartz et al. . | |
| 5,048,784 | 9/1991 | Schwartz et al. . | |
| 5,125,606 | 6/1992 | Cassano et al. . | |
| 5,131,614 | 7/1992 | Garcia et al. . | |
| 5,163,646 | 11/1992 | Engelhardt . | |
| 5,183,230 | 2/1993 | Walker et al. . | |
| 5,203,527 | 4/1993 | Rubey . | |
| 5,347,668 | 9/1944 | Manning | 5/643 X |

*Primary Examiner*—Karen J. Chotkowski

*Attorney, Agent, or Firm*—Kolisch Hartwell Dickinson McCormack & Heuser

[57] ABSTRACT

A wrist rest is disclosed for use with a keyboard. The wrist rest includes a bladder for holding a fluid, a pump operatively connected to the bladder for selectively filling the bladder with fluid and a valve for selectively releasing fluid from the bladder. The bladder preferably includes two elongate lobes interconnected by an isthmus. The lobes are shaped so that the perimeter of a horizontal cross-section through one of the elongate lobes is substantially elliptical in shape.

24 Claims, 2 Drawing Sheets

WRIST REST

FIELD OF THE INVENTION

This invention relates generally to a device and method for orienting a human user's arm, wrist and hand relative to a keyboard or the like to assist in the prevention of Carpal Tunnel Syndrome. More particularly, this invention relates to an inflatable wrist rest in which the amount of inflation is controllable by the user.

BACKGROUND ART

It is known that a resilient pad placed in front of a keyboard provides a support that helps orient the arm, wrist and hand of the user of the keyboard. The pad makes the use of the keyboard more comfortable and helps prevent Carpal Tunnel Syndrome. Furthermore, it is known to make such a resilient pad out of a water-filled pouch, as shown in Engelhardt, U.S. Pat. No. 5,163,646. However, the prior art does not show the use of a user controllable inflatable wrist rest, nor of a wrist rest having multiple inflated portions connected by a control portion.

SUMMARY OF THE INVENTION

The present invention is a wrist rest for use with a keyboard. The wrist rest includes a bladder for holding a fluid, a pump operatively connected to the bladder for selectively filling the bladder with fluid and a valve for selectively releasing fluid from the bladder. The bladder preferably includes two elongate lobes interconnected by an isthmus. The lobes are shaped so that the perimeter of a horizontal cross-section through one of the elongate lobes is substantially elliptical in shape.

It is an object of this invention to form a wrist rest with a fluid-cushioned support portion operatively connected to a fluid-control mechanism.

It is the further object of this invention to control the introduction of fluid into a fluid-cushioned support portion of a wrist rest.

DETAILED DESCRIPTION OF THE PREFERRED EMBODIMENT

Figure 1:
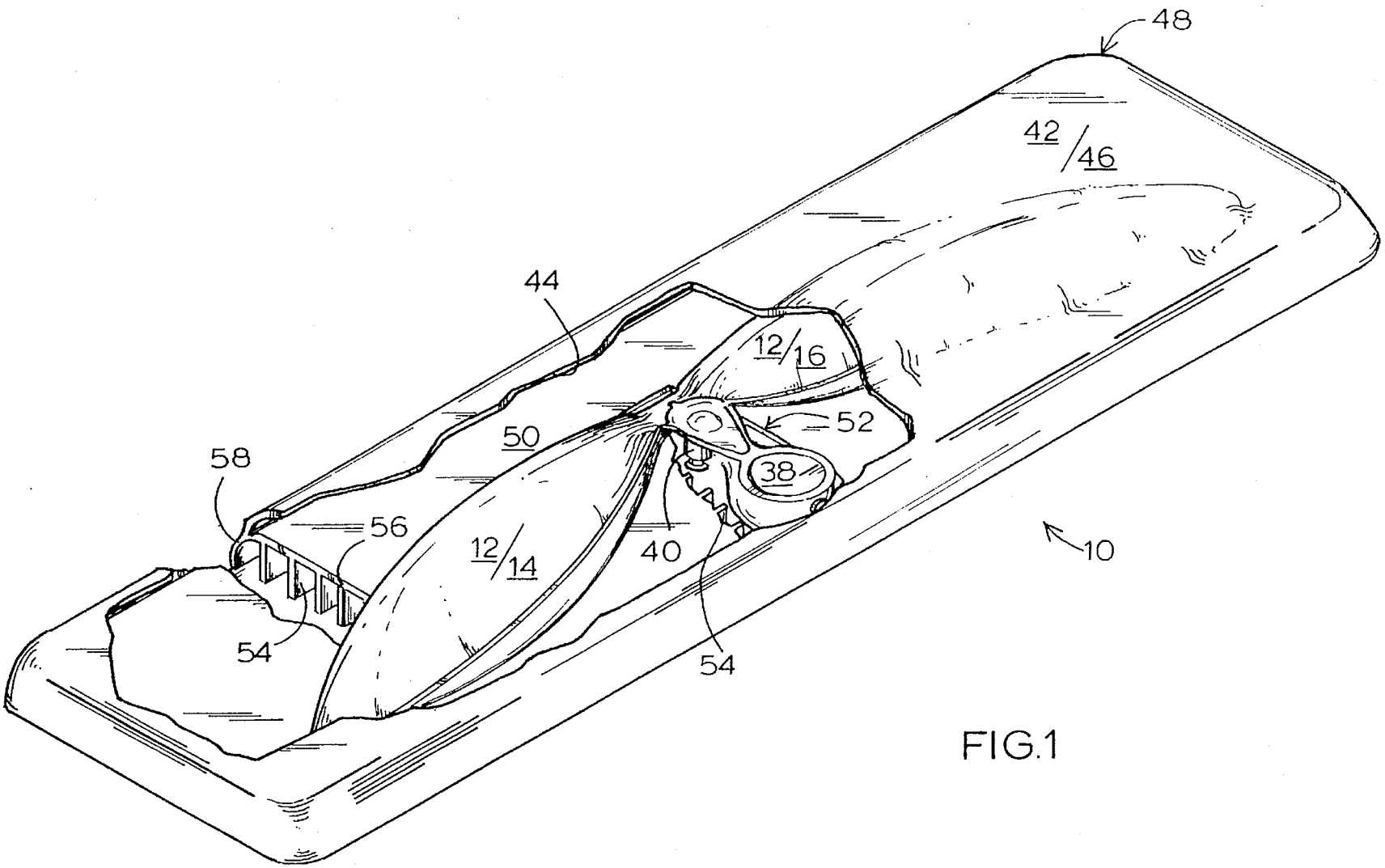
FIG. 1 is an isometric view of the wrist rest of the present invention with portions of the wrist rest being cut away to show the internal elements of the wrist rest.

Referring to FIG. 1, the wrist rest of the present invention is shown generally at 10. Wrist rest 10 can also be referred to as a support 10 for orienting a human user's arm, wrist and hand (not shown) relative to a keyboard (not shown) to assist in the prevention of carpel tunnel syndrome. It is to be understood that the word keyboard is used in a generic sense to refer to any device that is used in a repetitive manner, thus requiring the proper orientation of the operational positions of the arm, wrist and hand relative to the device. An inflatable bladder 12, when inflated, provides a fluid-cushioned support portion 12 on which the user's arm, wrist, hand or palm can be rested and supported, depending on the preferences of the user. In the preferred embodiment, bladder 12 has a first elongate lobe 14 and a second elongate lobe 16, which are also referred to as a first palm region 14 and second palm region 16.

Figure 2:
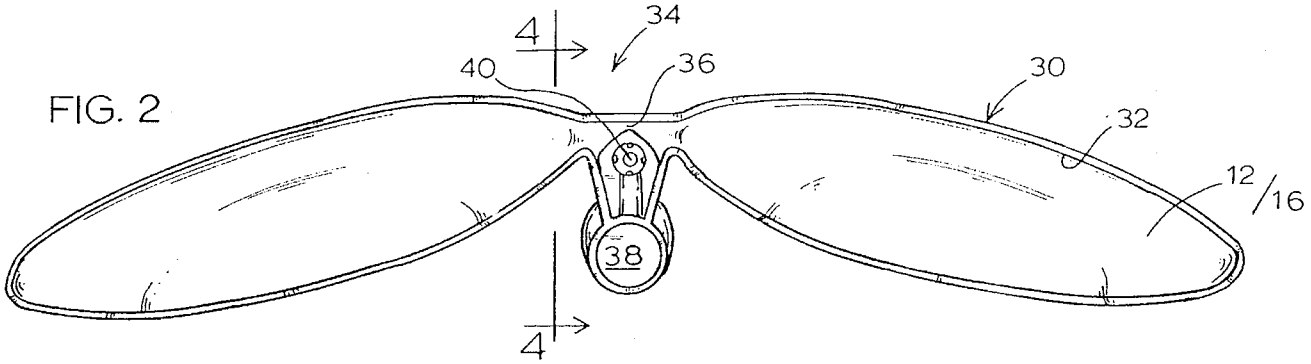
FIG. 2 is a top plan view of the bladder of the present invention shown removed from the wrist rest.
Figure 4:
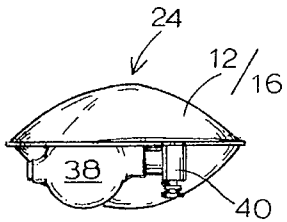
FIG. 4 is a cross-sectional view of the bladder shown in FIG. 2, taken along the line 4—4 in FIG. 2.
Figure 3:
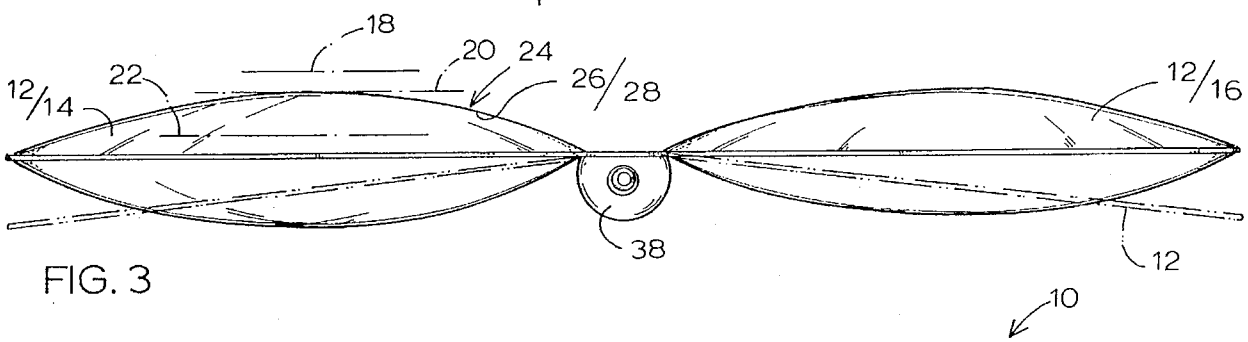
FIG. 3 is a front elevation of the bladder shown in FIG. 2, with the lobes of the bladder being shown in an inflated state in solid lines and in a deflated state in dashed lines.
Figure 5:
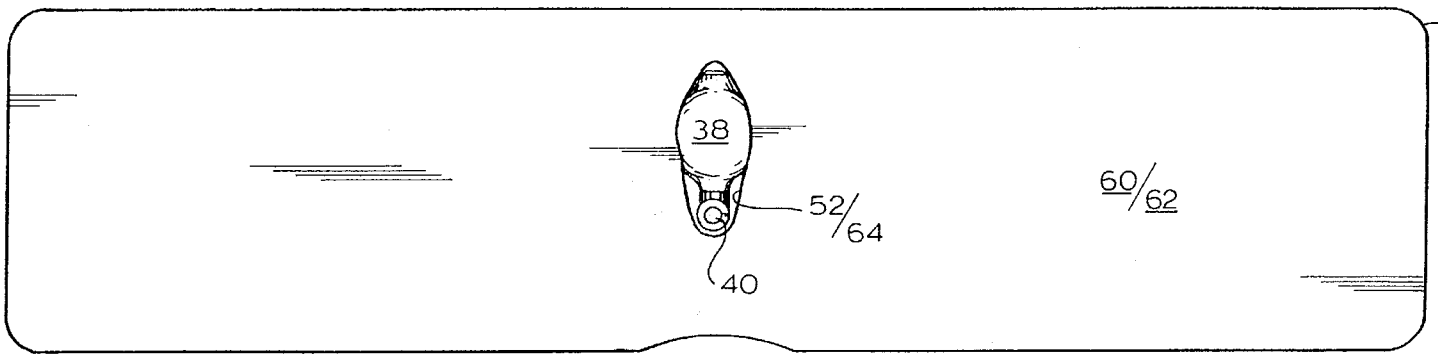
FIG. 5 is a bottom plan view of the wrist rest shown in FIG. 1.

In FIG. 3, reference lines are shown above the lobe as 18, at the top of the lobe as 20, and in the middle of, or within, the lobe as 22. The inflated lobe has a vertical cross-section 24 with a perimeter 26. The upper half of the perimeter is indicated generally at 28, and is cycloidal in shape when inflated, as shown. Referring now to FIG. 2, each lobe also has a horizontal cross-section 30 that has a perimeter 32 that is elliptical in shape. Described differently, it will be seen that the contour of the inflated lobe is such that, when viewed from above, a cross-section of the lobe progresses from a single point to an ellipse as the plane in which the inflated lobe is cross-sectioned progresses from top 20 toward middle 22. Thus, the inflated lobe is dome-shaped, has a single apex and gradually rises to a single maximum.

A change-configuration fluid-control mechanism 34 is connected to at least one of the lobes 14 or 16, and preferably includes an isthmus 36, also referred to more generally as a control portion 36. Control mechanism 34 can also preferably include a pump 38, which acts as a fluid-introduction device 38, and a valve 40, which acts as a fluid-release device 40. As shown best in FIG. 2, control mechanism 34 in the preferred embodiment is an integrated unit including isthmus 36, pump 38, and valve 40.

Other features of the preferred embodiment improve the comfort and appearance of support 10. A cover 42 overlies or encloses bladder 12, and defines a surface continuum for wrist rest 10. Cover 42 preferably extends outwardly substantially from lobes 14 and 16, as shown in FIG. 1, and is preferably made of resilient material 44 such as a resilient pad or a foam pad upholstered with a fabric covering 46. Cover 42 has a rounded perimeter indicated generally at 48, also referred to as the edges of cover 42. A spacer 50 in the form of a structure or frame underlies bladder 12, and has an opening 52 to allow access to pump 38 and release valve 40. Spacer 50 can include structural ribs 54 and outer wall 56 having a rounded perimeter 58. Perimeter 58, or edge 58, is conformed to the inside of cover 42. A footing 60 made of resilient material 62 in the form of a resilient pad or foam pad, underlies spacer 50 and has an opening 64 conformed to opening 52.

From the foregoing, it will be seen that what has been described is a wrist rest having a bladder with two elongate lobes interconnected by an isthmus. The isthmus provides a control portion that allows the passage of fluid between the lobes, but limits the speed with which the fluid can escape from one lobe into the other. Thus, a controlled amount of balancing is provided. Furthermore, by providing a pump and a valve connected to the bladder, the amount of fluid contained in the bladder can be controlled by the user. For example, some users may prefer a firm or hard wrist rest, in which case the bladder would be filled with more fluid. Alternatively, other users may prefer a soft wrist rest, in which case fluid can be released from the bladder.

Phrased alternatively, the invention is a change-configuration fluid-environment wrist rest 10 in which the change-configuration properties are provided by a change-configuration fluid-control 34 allows the configuration of the wrist rest to be changed by the user. Change-configuration fluid-control 34 includes a pump 38 with which the configuration of wrist rest 10 can be changed by introducing fluid into wrist rest 10. Furthermore, change-configuration fluid-control 34 also includes a valve 40 with which the configuration of wrist rest 10 can be changed by releasing fluid from wrist rest 10. In the preferred embodiment, the fluid-environment for wrist rest 10 is provided by bladder 12 for containing the fluid. Pump 38 and valve 40 are operatively connected to bladder 12.

INDUSTRIAL APPLICABILITY

The invented wrist rest is applicable in any situation in which a support is desired to orient a user's arm, wrist or hand relative to a keyboard or the like.

While a preferred embodiment of the invented wrist rest has been disclosed, changes and modifications can be made without departing from the spirit of the invention.

I claim:

1. A change-configuration fluid-environment wrist rest comprising:

a bladder having elongate lobes operatively connected by an isthmus; and change-configuration fluid-control mechanism including a pump operatively connected to the bladder for controlling the introduction of fluid into the bladder, and a valve operatively connected to the bladder for controlling the release of fluid from the bladder; wherein:

one of the lobes, when inflated, has a top and a middle; and the contour of the inflated lobe is such that, when viewed from above, a cross-section of the lobe progresses from a single point to an ellipse as the plane in which the inflated lobe is cross-sectioned progresses from the top toward the middle of the lobe.

2. The wrist rest of claim 1, further comprising:

a cover overlying the bladder and defining a surface continuum for the wrist rest; and a frame underlying the bladder for elevating and supporting the bladder.

3. A change-configuration fluid-environment wrist rest comprising:

a bladder for holding a fluid, the bladder having elongate lobes fluidically interconnected by an isthmus;

a pump operatively connected to the bladder for selectively filling the bladder with fluid;

a valve for selectively releasing fluid from the bladder;

a cover overlying the bladder and defining a surface continuum for the wrist rest; and a frame underlying the bladder for elevating and supporting the bladder.

4. The wrist wrest of claim 3, wherein one of the lobes, when inflated, is dome-shaped.

5. The wrist wrest of claim 3, wherein one of the lobes, when inflated, has a single apex.

6. The wrist wrest of claim 3, wherein one of the lobes, when inflated, gradually rises to a single maximum.

7. The wrist rest of claim 3, wherein the pump is connected directly to the isthmus.

8. The wrist rest of claim 3, wherein the valve is connected directly to the isthmus.

9. In a wrist rest for use with a keyboard, the improvement comprising:

a bladder for holding a fluid;

a pump operatively connected to the bladder for selectively filling the bladder with fluid; and a valve for selectively releasing fluid from the bladder; wherein:

the bladder comprises two elongate lobes the upper half of the perimeter of a vertical cross-section through an inflated one of the elongate lobes is substantially cycloidal in shape; and the perimeter of a horizontal cross-section through one of the elongate lobes is substantially elliptical in shape.

10. A wrist rest for use with a keyboard, the wrist rest comprising:

a bladder for holding a fluid;

a pump operatively connected to the bladder for selectively filling the bladder with fluid; and a valve for selectively releasing fluid from the bladder;

wherein the perimeter of a horizontal cross-section through the bladder when filled with fluid progresses from a point to an ellipse as the plane of cross-sectioning progresses from above the bladder to within the bladder.

11. A change-configuration fluid-environment wrist rest comprising:

a bladder having elongate lobes operatively interconnected by a change-configuration fluid-control mechanism including an isthmus, a pump for controlling the introduction of fluid into the bladder, and a valve for controlling the release of fluid from the bladder;

a cover overlying the bladder and defining a surface continuum for the wrist rest; and a frame underlying the bladder for supporting the bladder.

12. The wrist rest of claim 11, wherein one of the lobes, when inflated, is dome-shaped.

13. The wrist rest of claim 11, wherein one of the lobes, when inflated, has a single apex.

14. The wrist rest of claim 11, wherein one of the lobes, when inflated, gradually rises to a single maximum.

15. A wrist rest for use with a keyboard, the wrist rest comprising:

a bladder for holding a fluid, the bladder having plural lobes operatively connected by an isthmus:

a cover overlying the bladder and defining a surface continuum for the wrist rest;

a frame underlying the bladder for supporting the bladder;

a pump operatively connected directly to the isthmus for selectively filling the bladder with fluid; and a valve for selectively releasing fluid from the bladder.

16. The wrist rest of claim 15, wherein one of the lobes, when inflated, is dome-shaped.

17. The wrist rest of claim 15, wherein one of the lobes, when inflated, has a single apex.

18. The wrist rest of claim 15, wherein one of the lobes, when inflated, gradually rises to a single maximum.

19. The wrist rest of claim 15, wherein the valve is operatively connected directly to the isthmus.

20. A change-configuration fluid-environment wrist rest comprising:

a pair of inflatable lobes, wherein the lobes are mechanically attached and each of the lobes, when inflated, is dome-shaped;

a cover overlying the pair of lobes and defining a surface continuum for the wrist rest; and a frame underlying the pair of lobes for supporting the lobes.

21. The wrist rest of claim 20, wherein one of the lobes, when inflated, has a single apex.

22. The wrist rest of claim 20, wherein one of the lobes, when inflated, gradually rises to a single maximum.

23. A support for orienting the operational positions of the hands of a user relative to a keyboard, the support comprising:

a fluid-cushioned support portion; and fluid control mechanism operatively connected to the support portion and including structure for controlling the introduction of fluid into the support portion; wherein:

the support portion, when inflated, has a top and a middle; and the contour of the inflated support portion is such that, when viewed from above, a cross-section of the support portion progresses from a single point to an ellipse as the plane along which the support portion is cross-sectioned progresses from the top to the middle of the support portion.

24. A change-configuration fluid-environment wrist rest comprising:

a bladder for holding fluid, the bladder having elongate lobes fluidically interconnected by an isthmus;

a pump operatively connected to the bladder for selectively filling the bladder with fluid; and a valve for selectively releasing fluid from the bladder; wherein:

one of the lobes, when inflated, has a top and a middle; and the contour of the inflated lobe is such that, when viewed from above, a cross-section of the lobe progresses from a single point to an ellipse as the plane in which the inflated lobe is cross-sectioned progresses from the top toward the middle of the lobe.

* * * * *